US006496096B2

(12) United States Patent
Kondo et al.

(10) Patent No.: US 6,496,096 B2
(45) Date of Patent: Dec. 17, 2002

(54) FUSE ASSEMBLY

(75) Inventors: Hiroki Kondo, Shizuoka (JP); Goro Nakamura, Shizuoka (JP); Takahiro Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 91 days.

(21) Appl. No.: 09/799,689

(22) Filed: Mar. 7, 2001

(65) Prior Publication Data

US 2001/0026209 A1 Oct. 4, 2001

(30) Foreign Application Priority Data

Mar. 31, 2000 (JP) ..... 2000-099746

(51) Int. Cl.[7] ..... H01H 85/175; H01H 85/153

(52) U.S. Cl. ..... 337/234; 337/231; 337/252; 337/260; 337/262; 439/622; 439/890

(58) Field of Search ..... 337/186, 187, 337/228, 231, 234, 251, 252, 260, 262, 290, 295; 439/621, 622, 830, 890, 893; 29/623

(56) References Cited

U.S. PATENT DOCUMENTS 3,775,723 A * 11/1973 Mamrick et al. ..... 337/187
4,023,265 A * 5/1977 Aryamane ..... 29/417
4,040,175 A * 8/1977 Williamson et al. ..... 29/417
4,099,320 A * 7/1978 Schmidt et al. ..... 29/414
4,224,592 A * 9/1980 Urani et al. ..... 29/623
4,635,023 A * 1/1987 Oh ..... 337/163
4,831,353 A * 5/1989 Gaia et al. ..... 29/623
4,997,393 A 3/1991 Armando
4,997,939 A * 3/1991 Armando ..... 333/181
5,239,282 A * 8/1993 Filomia ..... 337/255
5,293,147 A * 3/1994 Oh et al. ..... 337/201
5,629,664 A * 5/1997 Muramatsu et al. ..... 337/190
5,668,521 A * 9/1997 Oh ..... 337/186
5,854,583 A * 12/1998 Falchetti ..... 337/159
5,977,859 A * 11/1999 Kawamura et al. ..... 29/623
6,359,543 B2 * 3/2002 Endo et al. ..... 337/159

FOREIGN PATENT DOCUMENTS

EP 354676 A1 * 2/1990 ..... H01H/69/02

OTHER PUBLICATIONS

German Patent Appln. Laid–open No. 2940607, Apr. 16, 1981, Wilholm Pudenz KG.
German Patent Appln. Laid–open No. 2946093, May 27, 1981, Wilholm Pudenz KG.

* cited by examiner

*Primary Examiner*—Anatoly Vortman
(74) *Attorney, Agent, or Firm*—Armstrong, Westerman & Hattori, LLP

(57) ABSTRACT

A fuse assembly, in which a pluraity of members constituting a housing of the fuse assembly can be mounted tightly and whether the fuse element has blown out or not can be easily checked, is provided. The fuse assembly 1 has a pair of terminals 2, a fuse element 5 and a housing 4. Each end 3*a* of the terminals 2 is received into the housing 4. The fuse element 5 connects the terminals 2 with each other. The fuse element 5 has a pair of locking claws 61. The housing 4 has casing members 4*a* and 4*b*, which receive each end 3*a* of the terminals 2 and the fuse element 5 when the casing members 4*a* and 4*b* are fit with each other in the housing 4. Each casing member 4*a* and 4*b* has a locking recess 64 for engaging with the locking claw 61. One locking claw 61 engages with one locking recess 64, while an opposite locking claw 61 engages with an opposite locking recess 64.

7 Claims, 4 Drawing Sheets

FUSE ASSEMBLY

BACKGROUND OF THE INVENTION (1) Field of the Invention

This invention relates to a fuse assembly and more specifically, to a fuse assembly, in which a pluraity of members constituting a housing of the fuse assembly can be mounted tightly and whether a fuse element of the fuse assembly has blown out or not can be easily checked.

(2) Description of the Related Art

In a vehicle as a mobile unit, many electric power transfer lines for transferring electric power itself or signals, such as busbars in an electric junction box such as a junction block, relay box and fuse block, and terminals for electric connection, are disposed.

In the electric power transfer lines, a fuse block, in which many fuses that can be inserted or extracted are disposed, is employed to protect electric circuits of various electrical equipments. (The fuse block may be called a relay box, junction block or electric junction box as the general term since the fuse block may have relays or busbars. In this specification, the aforementioned fuse block, relay box and junction block are hereinafter called an electric junction box as the general term.)

For example, a fuse assembly 101 shown in FIG. 7 has been employed as a fuse for use in the electric junction box. The fuse assembly 101 includes a pair of blade-shaped terminals 102, a fuse element (not shown in the figure) for connecting a pair of the terminals 102 with each other, and a housing 104 made of insulating synthetic resin and the like for receiving each one end of a pair of the terminals 102 and the fuse element.

When the fuse assembly 101 is mounted in the electric junction box, a pair of the terminals 102 is connected to respective receiving terminals of the electric junction box. Through the receiving terminal, an electric power is supplied to one terminal 102 from an electric power source or the like, while various load is electrically connected to an opposite terminal 102.

In the fuse assembly 101, when a current value of an electric power supplied to the one terminal 102 through the receiving terminal or the like exceeds a predetermined current value, the fuse element blows out so as to halt the power supply to the load.

The fuse assembly 101 is preferably provided with a partition wall between a pair of the terminals 102 in order to securely prevent the terminals 102 from making a short circuit with each other after the blowing. The partition wall is, for example, integrally produced with the insulating housing 104.

When the partition wall is set between a pair of the terminals 102, in order to receive each one end of a pair of the terminals 102 and the fuse element into the housing 104, the housing 104 needs to be formed being divided into a plurality of members, for example, two members. In this case, the housing 104 is constructed in a manner that the divided members put and receive a pair of the terminals 102 and the fuse element therebetween.

When the housing 104 is formed with dividing into a pluraity of the members, the clearance may take place between or among a pluraity of the members after the assembly of the housing 104. When the clearance takes place, due to vibrations of a vehicle such as a motorcar, into which the electric junction box is mounted, during the traveling, a pluraity of the members hit with each other in the mounted position of the electric junction box to make a noise, or when things come to the worst, a pluraity of the members might come off from the mounted position.

When the clearance takes place between or among a pluraity of the members and a pluraity of the members hit with each other in the mounted position of the electric junction box due to vibrations of the vehicle during the traveling, the fuse element might be deformed undesirably. Moreover, in the conventional fuse assembly 101, since each one end of a pair of the terminals 102 and the fuse element are received in the housing 104, it has been difficult to check whether the fuse element did blow out or not.

SUMMARY OF THE INVENTION

It is therefore an objective of the present invention to solve the above problem and to provide a fuse assembly, in which a pluraity of members constituting a housing of the fuse assembly can be mounted tightly and whether the fuse element has blown out or not can be easily checked.

In order to attain the above objective, the present invention is to provide a fuse assembly comprising: a pair of terminals provided in parallel with each other; a fuse element for connecting a pair of the terminals with each other; a plurality of casing members fit with each other for putting and receiving each one end of a pair of the terminals and the fuse element between a plurality of the casing members; and a plurality of electrically conductive locking claws electrically connected to a pair of the terminals, wherein a plurality of the locking claws are provided to a plurality of the casing members, respectively, protrude toward the outside of the casing member from either a pair of the terminals or the fuse element, and locks up an outer surface of said each casing member.

According to the fuse assembly described above, each locking claw, which protrudes toward the outside of the casing member from either a pair of the terminals or the fuse element, locks up an outer surface of the respective casing member. Thereby, either a pair of the terminals or the fuse element is securely fixed to the respective casing member. The locking claw protrudes toward an outer surface of the casing member, that is, the locking claw exposes to an outer surface of the fuse assembly.

Each casing member of a plurality of the casing members is provided with a locking recess for engaging with the locking claw.

According to the fuse assembly described above, the casing member has the locking recess, thereby the locking claw more securely locks up an outer surface of the respective casing member. Therefore, either a pair of the terminals or the fuse element is more securely fixed to the respective casing member.

The locking claw has a wide part and a narrow part that is narrower than the wide part, the wide part and the narrow part lie in a row along a direction, in which a plurality of the casing members put the terminals and the fuse element therebetween when said each locking claw locks up the outer surface of the respective casing member, said each locking recess is formed from the outer surface of the respective casing member and has a second wide part engaging with the wide part of the locking claw and a second narrow part engaging with the narrow part of the locking claw, and the second wide part and the second narrow part lie in a row along a direction, in which a plurality of the casing members put the terminals and the fuse element therebetween.

According to the fuse assembly described above, the locking claw has a wide part and a narrow part, and each locking recess has a second wide part engaging with the wide part of the locking claw and a second narrow part engaging with the narrow part of the locking claw. The wide part and the narrow part lie in a row along a direction, in which a plurality of the casing members put the terminals and the fuse element therebetween. The second wide part and the second narrow part lie in a row along a direction, in which a plurality of the casing members put the terminals and the fuse element therebetween.

Thereby, when the locking claw engages with the locking recess, either a pair of the terminals or the fuse element is fixed to the respective casing member and in addition, a plurality of the casing member are prevented from relatively displacing along a direction, in which a plurality of the casing members put ends of the terminals and the fuse element therebetween.

The narrow part is situated nearer to either a pair of the terminals or the fuse element than the wide part, and the second wide part is situated more outward from the casing member than the second narrow part.

According to the fuse assembly described above, when the locking claw engages with the locking recess, a plurality of the casing member are more securely prevented from relatively displacing along a direction, in which a plurality of the casing members put ends of the terminals and the fuse element therebetween.

Each terminal of a pair of the terminals is formed in a blade-shape, and the locking recesses are disposed symmetrically with respect to an axial line which is situated at the center of a pair of the terminals and extends along the direction of the length of the terminal.

According to the fuse assembly described above, the locking recess is provided at a symmetrical position with respect to the axial line, thereby a plurality of the casing member can be formed in the same shape with each other.

Each teminal of a pair of the terminals has a first through hole, the fuse element has a pair of second through holes, and said each casing member has: a first projection fitting into the first through hole of one terminal out of a pair of the terminals; a second projection fitting into one second through hole out of a pair of the second through holes; a first hole aligning with the first through hole of an opposite terminal out of a pair of the terminals; and a second hole aligning with an opposite second through hole out of a pair of the second through holes.

According to the fuse assembly described above, the first projection fits into the first through hole of one terminal, while the first hole aligns with the first through hole of an opposite terminal. The second projection fits into the second through hole of the one terminal, while the second hole aligns with the second through hole of the opposite terminal.

Thereby, the first projection of one casing member out of-a plurality of the casing members is fit into the first through hole of the one terminal, then is fit into the first hole of an opposite casing member. The second projection of the one casing member is fit into the second through hole of the one terminal, then is fit into the second hole of the opposite casing member, thereby the casing members can be fit with each other in the housing of the fuse assembly. In addition, the terminals and the fuse elements can be mounted to the casing member.

A pair of the first through holes is disposed symmetrically with respect to an axial line which is situated at the center of a pair of the terminals and extends along the direction of the length of the terminal, and a pair of the second through holes is also disposed symmetrically with respect to the axial line.

According to the fuse assembly described above, a plurality of the casing member can be formed in the same shape with each other.

DESCRIPTION OF THE PREFERRED EMBODIMENTS

In the following, a preferred embodiment of the present invention will be explained with reference to FIGS. 1 to 6. As shown in FIGS. 1 to 4, a fuse assembly 1 according to the preferred embodiment of the present invention has a pair of terminals 2 provided in parallel with each other, a fuse element 5 for connecting a pair of the terminals 2 with each other, and a housing 4 of the fuse assembly 1 for receiving ends 3*a* of the terminals 2 and the fuse element 5.

Figure 4:
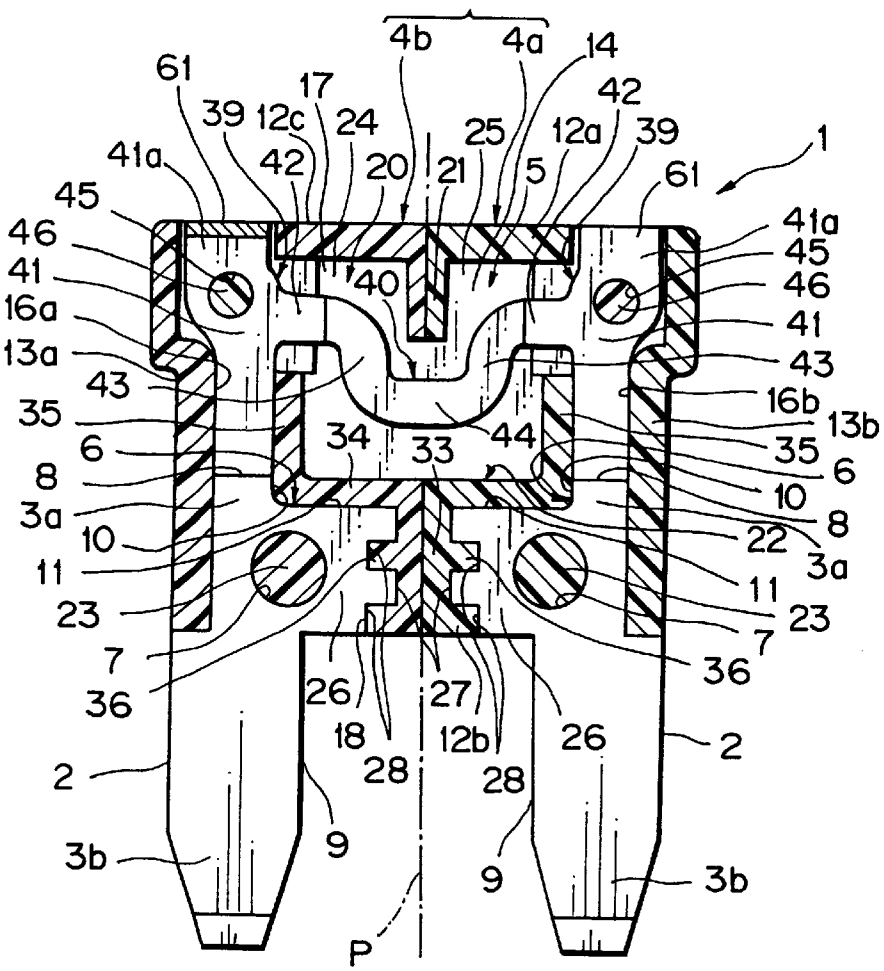
FIG. 4 is a sectional view taken along IV—IV line in FIG. 1.

Each terminal 2 formed in a blade-shape is made of an electrically conductive material and the pair of the terminals 2 is arranged in parallel with each other. In the terminal 2, one end 3*a* thereof is received into the housing 4 and an opposite end 3*b* thereof is exposed the outside of the housing 4. As shown in FIG. 4, the terminal has a notched part 6, a protrusion 26 protruding inwardly in the housing 4, and an mounting hole 7 (corresponding to a first through hole described in the claim).

The notched part 6 is provided to the end 3*a*. The notched part 6 is formed concave in a direction, in which a pair of the terminals 2 aparts from each other from an end surface 27 (described later) of the protrusion 26. The notched part 6 is formed so that a distance between the two terminals 2 increases in stages from a distance between the two protrusions 26.

The notched part 6 has: a flat surface 10 extending toward the center along a direction of the length of the terminal 2 starting from an end surface 8, which is situated at the end 3*a* of the terminal 2; and a step surface 11 which continues the flat surface 10 to an end surface 27 of the protrusion 26. The flat surface 10 is formed flat along the direction of the length of the terminal 2. A distance between the two flat surfaces 10 is formed longer than that between two inner surfaces 9 of the opposite end 3*b* of the terminal 2.

The step surface 11 is formed along a direction in which a pair of the terminals 2 aparts or approaches with each other, that is, a direction in which the terminals 2 are arranged in parallel. The notched part 6 is received in the housing 4 when the terminal 2 is mounted in the housing 4.

The protrusion 26 is provided to the end 3*a* of the terminal 2. The protrusion 26 is provided at a little center side of the terminal from compared to notched part 6. The protrusion 26 protrudes in a direction that a pair of the terminals 2 approaches with each other from the respective inner surface 9. The protrusion 26 has the end surface 27 and a concaved part 28 formed concave from the end surface 27.

The end surface 27 is formed flat along a direction of the length of the terminal 2. The concaved part 28 is formed concave in a direction that a pair of the terminals 2 aparts from each other from the end surface 27.

In the figure, the two concaved parts 28 are provided to one end surface 27, that is, to one terminal 2. The protrusion 26 is received in the housing 4 when the end 3*a* of the terminal 2 is received in the housing 4.

The mounting hole 7 penetrates through the terminal 2. The mounting hole 7 is provided to the end 3*a* of the terminal 2. The mounting hole 7 is situated a little near to the center of the terminal 2 compared to the notched part 6. Each mounting hole 7 is formed round in its plane shape and is disposed symmetrically with respect to an axial line P (shown in FIGS. 3 and 4) which is situated at the center of a pair of the terminals 2 and extends along the direction of the length of the terminal 2.

When the fuse assembly 1 is mounted in an electric junction box, each opposite end 3*b* of the respective terminal 2 is electrically connected to a receiving terminal and the like of the electric junction box. An electric power from a power source and the like is supplied to one of the receiving terminal. A various load is electrically connected to an opposite receiving terminal. Therefore, an electric power is supplied to one terminal 2 out of the two terminals 2 through the receiving terminal, while a load is connected to an opposite terminal 2.

Figure 1:
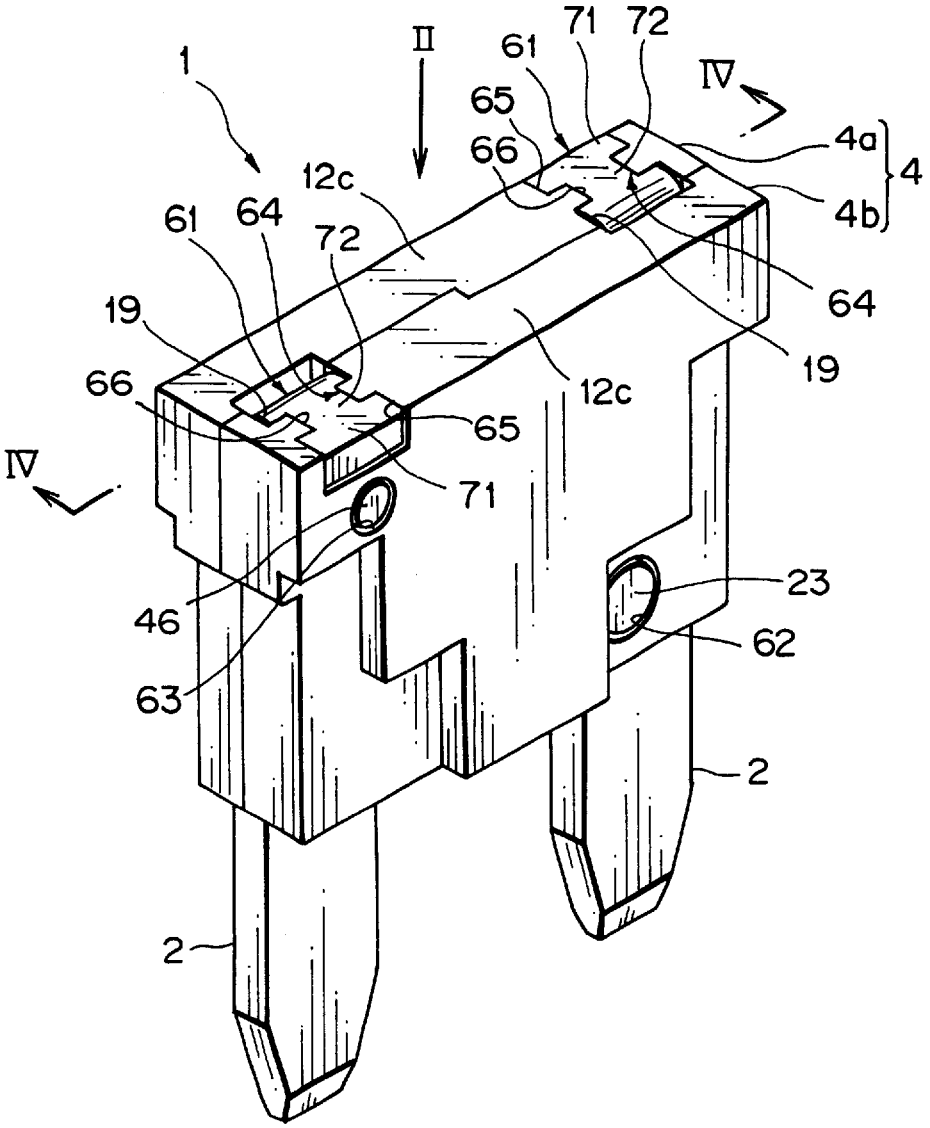
FIG. 1 is a perspective view of a fuse assembly according to a preferred embodiment of the present invention.
Figure 2:
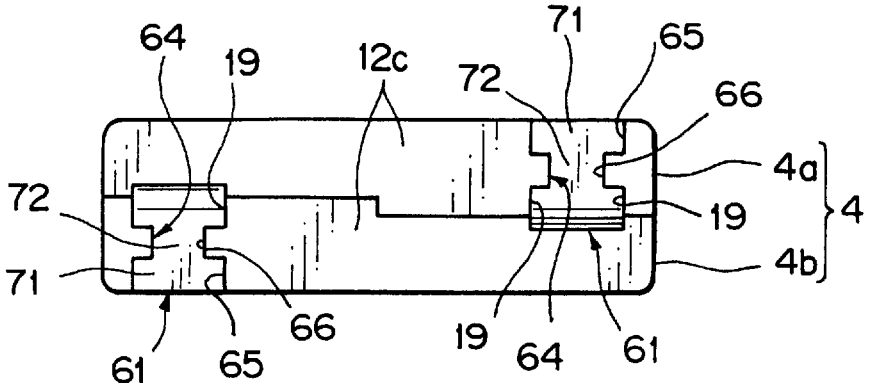
FIG. 2 is a view viewed from a direction of arrow II in FIG. 1.
Figure 3:
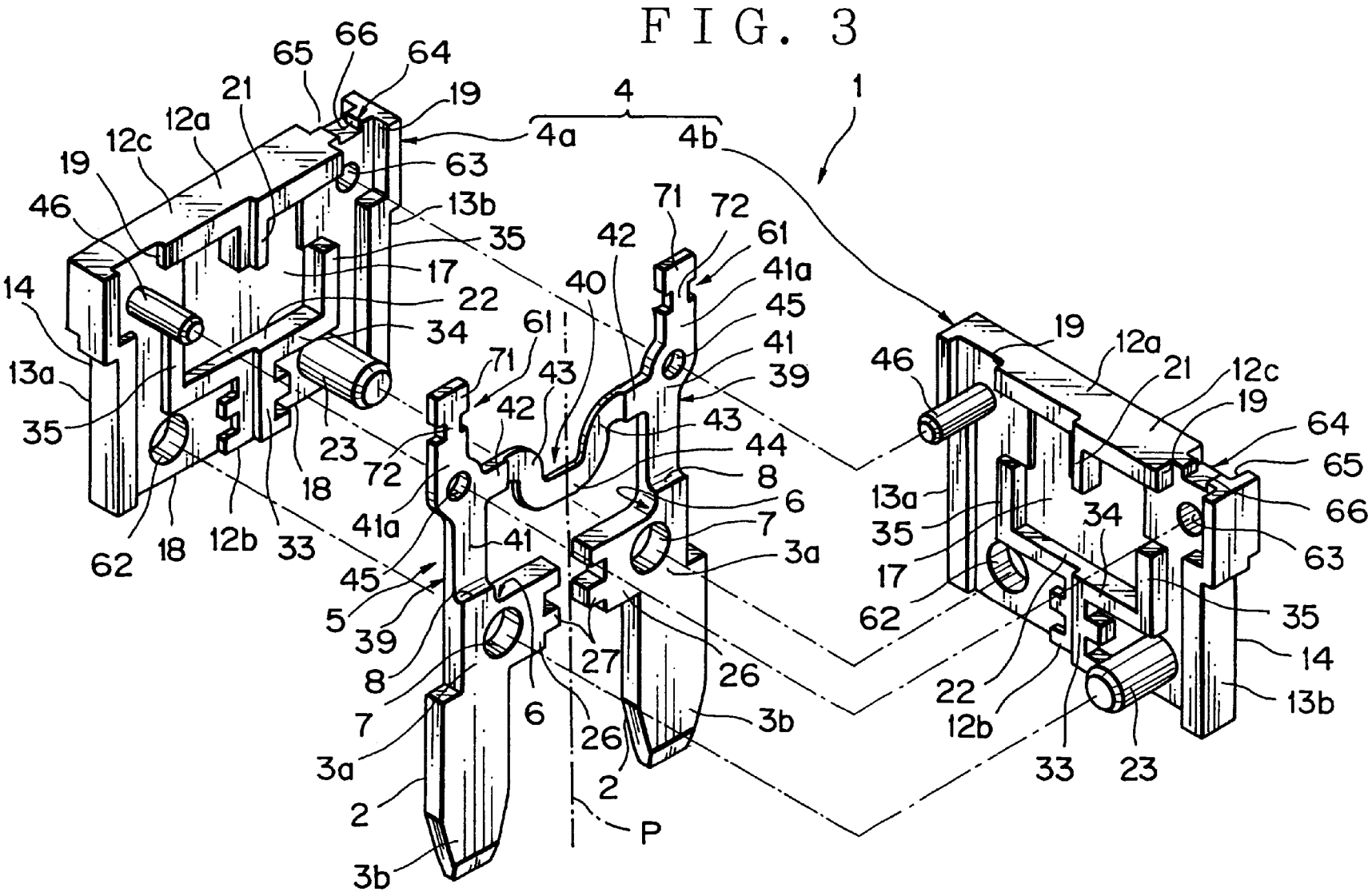
FIG. 3 is an exploded perspective view of the fuse assembly shown in FIG. 1.
Figure 7:
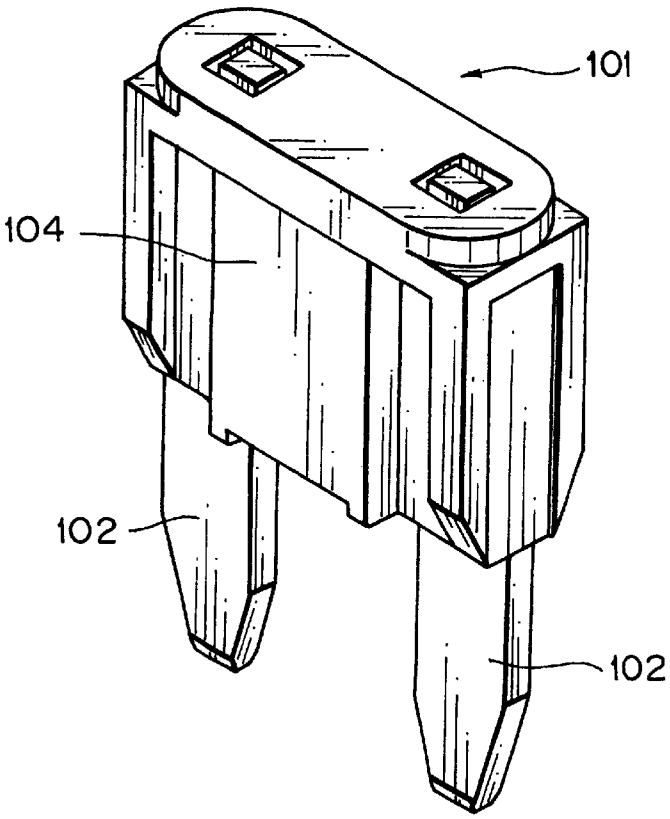
FIG. 7 PRIOR ART
FIG. 7 is a perspective view of a conventional fuse assembly.

The housing 4 is made of an insulating synthetic resin and so on. The housing 4 is formed in a box-shape, and as shown in FIGS. 1 to 3 has a pair of casing members 4*a* and 4*b*, which are fit with each other.

The casing members 4*a* and 4*b* are fit with each other in a manner that edges of end walls 12*a*, 12*b* (described later) and side walls 13*a*, 13*b* (described later) faces with each other, constituting the housing 4 which receives the ends 3*a* of the terminals 2 and the fuse element 5. The casing members 4*a* and 4*b* put the ends 3*a* of the terminals 2 and the fuse element 5 therebetween along a direction that body walls 14 (described later) approaches or aparts from each other.

Figure 5:
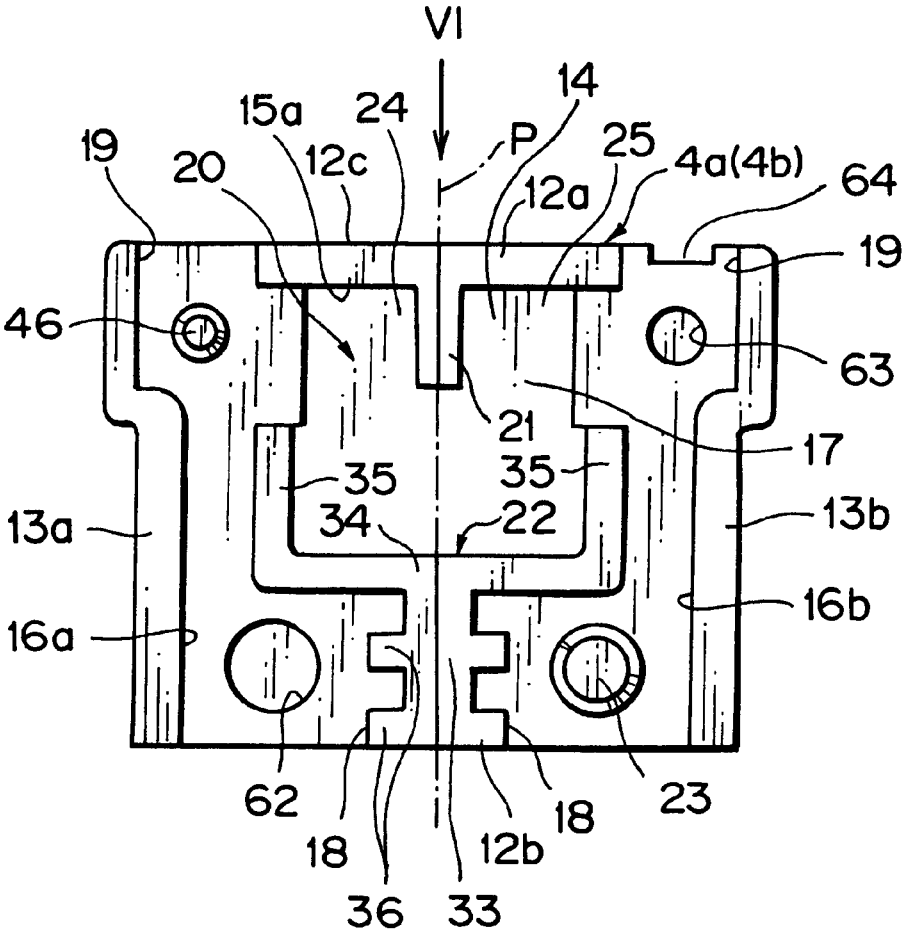
FIG. 5 is a case member of the fuse assembly shown in FIG. 1.
Figure 6:
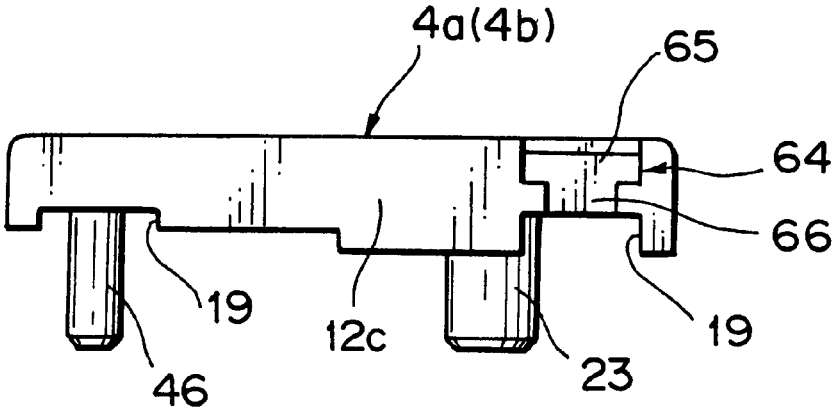
FIG. 6 is a view viewed from a direction of arrow VI in FIG. 5.

Since the casing member 4*a* has an identical constitution with that of the casing member 4*b*, only the casing member 4*a* will be explained hereinafter. As shown in FIGS. 4 and 5, the casing member 4*a* has a pair of the end walls 12*a* and 12*b*, a pair of the side walls 13*a* and 13*b*, and the body wall 14.

A pair of the end walls 12*a* and 12*b* faces with each other along a direction crossing with the direction in which a pair of the terminals 2 is arranged in parallel. A pair of the end walls 12*a* and 12*b* faces with each other along the direction of the length of the terminal 2. A pair of the end walls 12*a* and 12*b* is in parallel with the end surface 8 when the housing 4 receives terminals 2.

The end wall 12*a* out of a pair of the end walls faces the end surface 8 of the terminal 2 with leaving a space therebetween.

A pair of the side walls 13*a* and 13*b* faces with each other along the direction in which a pair of the terminals 2 is arranged in parallel. A pair of the side walls 13*a* and 13*b* is formed along the direction of the length of the terminal 2.

The body wall 14 extends along the length of the terminal 2. The body wall 14 continues to a pair of the end walls 12*a* and 12*b* and a pair of the side walls 13*a* and 13*b*. The body wall 14 of the casing member 4*a* faces the body wall 14 of the casing member 4*b* along a direction crossing with the direction in which a pair of the terminals 2 is arranged in parallel when the casing members 4*a* and 4*b* are fit with each other.

When the casing members 4*a* and 4*b* are fit with each other, a space 20 (shown in FIG. 4), which is surrounded by an inner surface 15*a* of the end wall 12*a*, the end wall 12*b*, inner surfaces 16*a* and 16*b* of the side walls 13*a* and 13*b*, respectively, and an inner surface 17 of the body wall 14, forms a room for receiving the end 3*a* of the terminal 2.

On the end wall 12*b*, which is situated nearer to the center of the terminal 2 than the end wall 12*a*, there is formed a pair of through holes 18 for passing the respective terminals 2. On the end wall 12*a*, which faces the end surface 8 of the terminal 2, there is formed a through hole 19 for exposing a locking claw 61 (explained later) of the fuse element 5 outside the housing 4.

As shown in FIGS. 3 to 5, the casing member 4*a* has a partition wall 21, a second partition wall 22, a first projection 23, a second projection 46, a hole 62 as a first hole, a hole 63 as a second hole, and a locking recess 64.

The partition wall 21 extends from the inner surface 15*a* of the end wall 12*a*, which faces the respective end surface 8 with leaving a space therebetween, toward the end wall 12*b*. The partition wall 21 extends along the direction of the length of the side walls 13*a* and 13*b*, and the terminal 2.

The partition wall 21 is provided between a pair of the terminals 2 along a direction in which the terminals are arranged in parallel with each other. The partition wall 21 partitions the space 20 formed in the housing 4 into a first space 24 for receiving the end 3*a* of one terminal out of a pair of the terminals 2 and a second space 25 for receiving the end 3*a* of an opposite terminal out of a pair of the terminals 2. The first space 24 is situated at left and the second space 25 is situated at right in the figure.

The second partition wall 22 has a base wall 33, a horizontal wall 34, and a pair of partitions 35. The base wall 33 extends from an edge of the through hole 18 of the end wall 12*b* toward the inner surface 15*a* of the end wall 12*a* along the direction of the length of the terminal 2. The base wall 33 is arranged between the inner protrusion 26 of a pair of the terminals 2. The base wall 33 has a plurality of protrusions 36 engaging with the concaved parts 28. The base wall 33 covers the end surface 27 of the terminal 2 when the end 3*a* of the terminal 2 is received in the space 20.

The horizontal wall 34 continues to an end of the base wall 33 situated away from the end wall 12*b*. The horizontal wall 34 extends along the direction in which a pair of the terminals 2 is arranged in parallel with each other. The horizontal wall 34 extends from an end near to the inner surface 15*a* of the base wall 33 toward both of a pair of the terminals 2. The horizontal wall 34 is formed along the step surface 11. The horizontal wall 34 covers the step surface 11 of the terminal 2 when the end 3*a* of the terminal 2 is received in the space 20.

A pair of the partitions 35 continues to both ends of the horizontal wall 34 near to a pair of the terminals 2. A pair of the partitions 35 extends from both ends of the horizontal wall 34 toward the inner surface 15*a* and is formed along a flat surface 10 of the notched part 6 of the terminal 2.

A pair of the partitions 35 is arranged in parallel with each other along the direction in which a pair of the terminals 2 is arranged in parallel with each other. Each partition 35 is provided between each inner surface 16*a* and 16*b* of the side wall 13*a* and 13*b*, respectively, and the partition wall 21. A pair of the partitions 35 covers the flat surface 10 of the terminal 2 when the end 3*a* of the terminal 2 is received in the space 20.

The first projection 23 protrudes from an inner surface 17 of the body wall 14 of one casing member toward the body wall 14 of an opposite casing member 4*b*. The first projection 23 is formed in a cylindrical shape having an outer diameter, which is about the same with an inner diameter of the mounting hole 7. The first projection 23 is situated in the vicinity of the one side wall 13*b* and near to the end wall 12*b*. The first projection 23 fits into the mounting hole 7 of one terminal 2.

The second projection 46 protrudes from the inner surface 17 of the body wall 14 toward the body wall 14 of the opposite casing member 4*b*. The second projection 46 is formed in a cylindrical shape having an outer diameter, which is about the same with an inner diameter of the through hole 45 (described later) of the fuse element 5.

The second projection 46 is situated in the vicinity of the opposite side wall 13*a* and near to the end wall 12*a*. The second projection 46 fits into one through hole 45 out of a pair of the through holes 45 of the fuse element 5.

The hole 62 is formed from the inner surface 17 of the body wall 14. The hole 62 penetrates through the body wall 14. The hole 62 is formed in a round shape of its plan view having an inner diameter, which is about the same with an inner diameter of the mounting hole 7. The hole 62 is situated in the vicinity of the opposite side wall 13*a* and near to the end wall 12*b*.

When a pair of the terminals 2 is received in the housing 4, the hole 62 is symmetrically disposed in relation with the second projection 23 with respect to the axial line P. The hole 62 aligns with the mounting hole 7 of the opposite terminal 2.

The hole 63 is fromed from the inner surface 17 of the body wall 14. The hole 63 penetrates through the body wall 14. The hole 63 is formed in a round shape of its plan view having an inner diameter, which is about the same with an inner diameter of the through hole 45. The hole 63 is situated in the vicinity of the one side wall 13*b* and near to the end wall 12*a*.

When a pair of the terminals 2 is received in the housing 4, the hole 63 is symmetrically disposed in relation with the second projection 46 with respect to the axial line P. The hole 63 aligns with the opposite through hole 45 out of a pair of the through holes 45 of the fuse element 5.

The locking recess 64 is formed from a surface of the casing member 4*a*, which constitutes an outer surface of the housing 4. The locking recess 64 is formed from an outer surface 12*c* of the end wall 12*a* out of the surface of the casing member 4*a*. The outer surface 12*c* constitutes the outer surface of the housing 4.

The locking recess 64 is formed over the one through hole 19 and the body wall 14. The locking recess 64 is provided with a second wide part 65 and a second narrow part 66, which continue with each other. When a locking claw 61 (described later) engages with the locking recess 64, the second wide part 65 and the second narrow part 66 continue with each other along a direction, in which the casing members 4*a* and 4*b* put the ends 3*a* of a pair of the terminals 2 and the fuse element 5 therebetween. The second wide part 65 and the second narrow part 66 are formed in rectangular.

The second wide part 65 is situated near to the body wall 14, that is, outside of the casing member 4*a*, while the second narrow part 66 is situated near to the through hole 19. The second wide part 65 is formed over the outer surface of the body wall 14 as well. A width of the second wide part 65, which runs parallel to the direction of the width direction of the terminal 2, that is, the direction of the width of the housing 4 and the body wall 17, is formed longer than that of the second narrow part 66.

When the locking claw 61 is bent toward the bottom of the locking recess 64, the second wide part 65 engages with a wide part 71 (described later) of the locking claw 61. When the locking claw 61 is bent toward the bottom of the locking recess 64, the second narrow part 66 engages with a narrow part 72 (described later) of the locking claw 61. When the casing members 4*a* and 4*b* are fit with each other, each locking recess 64 of the casing members 4*a* and 4*b* is symmetrically disposed with each other with respect to the axial line P.

As shown in FIGS. 3 and 4, the fuse element 5 connects the terminals 2. The fuse element 5 and a pair of the terminals 2 are produced by rolling, cutting and pressing a single material. That is, the fuse element 5 and a pair of the terminals 2 are integrally formed.

The fuse element 5 is formed in a line shape with its cross section being rectangular shape. The fuse element 5 is formed to have a dimension of width, thickness and length of the central part thereof so that the fuse element 5 blows out when the current exceeds a predetermined value.

The fuse element 5 connects the end surfaces 8 of the terminal 2 with each other. As shown in FIGS. 3 and 4, the fuse element has a pair of holders 39, the central part 40 as a fuse part, a pair of through holes 45 as the second through hole, and a pair of the locking claws.

Each holder 39 has a first extended part 41 and a second extended part 42. The first extended part 41 extends from the end surface 8 toward the inner surface 15*a* of the end wall 12*a*, that is, in a direction of leaving from a pair of the terminals 2.

The first extended part 41 is formed in a belt shape with one end being connected to the end surface 8. The first extended part 41 is provided between each inner surface 16*a* or 16*b* and the partition 35 along the direction, in which the terminals 2 are arranged in parallel with each other. The first extended part 41 runs parallel to the side wall 13*a* and 13*b*, the base wall 33, the partition 35 and the partition wall 21.

The second extended part 42 is formed in a belt shape with one end being connected to the first extended part 41. The second extended part 42 extends from an end 41*a*, which is away from the end surface 8 of the first extended part 41 in a direction of approaching with each other. The second extended part 42 is provided between an end of the partition 35 and the inner surface 15*a* of the end wall 12*a*. The second extended part 42 is formed along the inner surface 15*a* of the end wall 12*a* and the horizontal wall 34.

The central part 40 is situated at the center between the two terminals 2 along the direction in which a pair of the terminals 2 is arranged in parallel with each other. The central part 40 has a pair of third extended parts 43 and a connection part 44. The third extended part 43 is formed in a belt shape with one end being connected to the second extended part 42. The third extended part 43 extends from an end, to which each second extended part 42 approachs with each other, in a direction of approaching the terminal 2 along the direction of the length of the terminal 2.

The third extended part 43 is provided between a pair of the partitions 35 and the partition wall 35 along the direction in which a pair of the terminals 2 is arranged in parallel with each other. The third extended part 43 runs parallel to the base wall 33, a pair of the partitions 35, the inner surface 16*a* and 16*b*, and the partition wall 21.

The connection part 44 is formed in a belt shape with connecting ends, at which the third extended part 43 most approaches the terminal 2, with each other. The connection part 44 is provided between the partition wall 21 and the horizontal wall 34. The connection part 44 is formed along the inner surface 15*a* of the end wall 12*a*, the end wall 12*b*, and the horizontal wall 34. The connection part 44 is situated at the center between the two terminals 2 along the direction in which a pair of the terminals 2 is arranged in parallel with each other.

The fuse element 5 is formed in a manner that a thickness of the first extended part 41 is larger than that of the connection part 44. The fuse element 5 is formed in a manner that a thickness thereof decreases stepwise in a direction from the first extended part 41 to the connection part 44.

The through hole 45 penetrates through the first extended part 41 of the holder 39. The through hole 45 is provided at an end 41*a* away from the end surface 8 of the first extended part 41. The through hole 45 is formed in a round shape of its plan view.

Each locking claw 61 is provided in response to the respective terminal 2. The locking claw 61 is made of electrically conductive metal and the like and is integrally formed with the first extended part 41 of the fuse element 5. Therefore, the locking claw 61 is electrically connected to the respective terminal 2. The locking claw 61 protrudes from the first extended part 41 toward the housing 4, that is, toward the outside of the casing member 4*a* penetrating through the through hole 19.

When the locking claw 61 protrudes toward the outside of the casing member 4*a*, the locking claw 61 is bent toward the bottom of the locking recess 64 and engages with the locking recess 64. That is, the locking claw 61 engages with the outer surface 12*c* of the housing 4, that is, the outer surface 12*c* of the casing member 4*a*.

The locking claw 61 has a wide part 71 and a narrow part 72. When the locking claw 61 engages with the locking recess 64, the wide part 71 and the narrow part 72 continue with each other along a direction, in which the casing members 4*a* and 4*b* put the ends 3*a* of the terminals 2 and the fuse element 5 therebetween. The wide part 71 and the narrow part 72 are formed in a rectangular shape.

The wide part 71 is situated away from the end surface 8, while the narrow part 72 is situated near to the end surface 8, that is, near to the fuse element 5. A width of the wide part 71, which runs parallel to the direction of the width direction of the terminal 2, that is, the direction of the width of the housing 4 and the body wall 17, is formed longer than that of the narrow part 72.

When the locking claw 61 is bent toward the bottom of the locking recess 64, the wide part 71 enters into the second wide part 65 of the locking recess 64. The wide part 71 engages with the second wide part 65. When the locking claw 61 is bent toward the bottom of the locking recess 64, the narrow part 72 enters into the second narrow part 66 of the locking recess 64. The narrow part 72 engages with the second narrow part 66.

When the locking claw 61 is bent toward the bottom of the locking recess 64, the wide part 71 and the narrow part 72 enter into the second wide part 65 and the second narrow part 66, respectively, thereby the locking claw 61 engages with the locking recess 64. The wide part 71 and the narrow part 72 are situated on about the same plane with that of the outer surface 12*c* of the casing member 4*a*.

Upon the assembly of the fuse assembly 1, the first projection 23 of the one casing member 4*a* is penetrated through the mounting hole 7 of the one terminal 2 and the second projection 46 is penetrated through the one through hole 45, thereby mounting the terminal 2 and the fuse element 5 to the casing member 4*a*. At this time, the mounting hole 7 of the opposite terminal 2 aligns with the hole 62, while the opposite through hole 45 aligns with the hole 63.

The first projection 23 of the opposite casing member 4*b* is penetrated through the mounting hole 7, which aligns with the hole 62, and the second projection 46 is penetrated through the opposite through hole 45, which aligns with the hole 63, and edges of the end walls 12*a* and 12*b* of each casing member 4*a* and 4*b* are put on top of each other, while the side walls 13*a* and 13*b* of each casing member 4*a* and 4*b* are put on top of each other. At this time, the projections 23 and 46 of the one casing member 4*a* enter into the hole 62 and the hole 63 of the opposite casing member 4*b*, respectively.

Then, the projections 23 and 46 are welded into the holes 62 and 63, respectively, so as to fix the casing members 4*a* and 4*b* with each other. At this time, the locking claw 61 penetrates through the through hole 19 and protrudes toward the outside of the housing 4, that is, the outside of the casing members 4*a* and 4*b*.

Then, one locking claw 61 is bent toward the bottom of the locking recess 64 of the one casing member 4*a*, while an opposite locking claw 61 is bent toward the bottom of the locking recess 64 of the opposite casing member 4*b*. Then, each locking claw 61 is engaged with the respective locking recess 64 and the fuse element 5 is fixed to the casing members 4*a* and 4*b*.

One locking claw 61 is engaged with the locking recess 64 of the one casing member 4*a*, while an opposite locking claw 61 is engaged with the locking recess 64 of the opposite casing member 4*b*, thereby the casing members 4*a* and 4*b* are tightly fit with each other along the projections 23 and 46. That is, The casing members 4*a* and 4*b* are tightly fit with each other, with putting the ends 3*a* of a pair of the terminals 2 and the fuse element 5 therebetween.

The fuse assembly 1 is mounted in the electric junction box and so on. After the mounting, when the current of power, supplied to one terminal out of a pair of the terminals through the one receiving terminal and the like, exceeds the predetermined value, the central part 40 of the fuse element 5 blows out to halt the power supplying to the load.

According to the fuse assembly 1 of the preferred embodiment, the one locking claw 61, which has protruded from the fuse element 5 toward the outside of the casing members 4*a* and 4*b*, engages with the locking recess 64 of the one casing member 4*a*, while the opposite locking claw 61 engages with the locking recess 64 of the opposite casing member 4*b*.

The locking claw 61 and the locking recess 64 have the wide part 71 and the wide part 65, which engage with each other, respectively, and the narrow part 72 and the narrow part 66, which also engage with each other, respectively. The wide parts 71 and 65 continue to the narrow parts 72 and 66, respectively, along the direction, in which the casing members 4*a* and 4*b* put the terminals 2 and the fuse element 5 therebetween. The wide parts 71 and 65 are disposed more outside of the housing 4 than the narrow parts 72 and 66.

Therefore, when the locking claw engages with the locking recess, the casing members 4*a* and 4*b* are prevented from relatively displacing along the projections 23 and 46, that is, along a diection in which the casing members 4*a* and 4*b* put the terminals 2 and the fuse element 5 therebetween. Consequently, the casing members 4*a* and 4*b* are tightly fit with each other along a direction in which the casing members 4*a* and 4*b* put the terminals 2 and the fuse element 5 therebetween.

The locking claw 61 protrudes toward the outside of the casing members 4*a* and 4*b*, one locking claw 61 is electrically connected to one terminal 2, and an opposite locking claw 61 is electrically connected to an opposite terminal 2. Thereby, by confirming whether there is an electric continuity between the locking claws 61 or not, it can be easily confirmed whether the fuse element 5 has blown out or not.

When the casing members 4*a* and 4*b* are fit with each other, since each set of the locking recesses 64, the first projections 23 and the second projections 46 is disposed at a respective symmetrical position with respect to the axial line P, the casing members 4*a* and 4*b* can be formed in the same shape with each other. Therefore, the number of variety of the components constituting the fuse assembly 1 can be minimized.

The aforementioned preferred embodiments are described to aid in understanding the present invention and variations may be made by one skilled in the art without departing from the spirit and scope of the present invention.

What is claimed is:

1. A fuse assembly comprising:

a pair of terminals provided in parallel with each other;

a fuse element for connecting a pair of the terminals with each other;

a plurality of casing members fit with each other for putting and receiving each one end of a pair of the terminals and the fuse element between a plurality of the casing members; and a plurality of electrically conductive locking claws electrically connected to a pair of the terminals, wherein a plurality of the locking claws are provided to a plurality of the casing members, respectively, protrude toward the outside of the casing member from either a pair of the terminals or the fuse element, and locks up an outer surface of said each casing member.

2. The fuse assembly according to claim 1, wherein each casing member of a plurality of the casing members is provided with a locking recess for engaging with the locking claw.

3. The fuse assembly according to claim 2, wherein the locking claw has a wide part and a narrow part that is narrower than the wide part, the wide part and the narrow part lie in a row along a direction, in which a plurality of the casing members put the terminals and the fuse element therebetween when said each locking claw locks up the outer surface of the respective casing member, said each locking recess is formed from the outer surface of the respective casing member and has a second wide part engaging with the wide part of the locking claw and a second narrow part engaging with the narrow part of the locking claw, and the second wide part and the second narrow part lie in a row along a direction, in which a plurality of the casing members put the terminals and the fuse element therebetween.

4. The fuse assembly according to claim 3, wherein the narrow part is situated nearer to either a pair of the terminals or the fuse element than the wide part, and the second wide part is situated more outward from the casing member than the second narrow part.

5. The fuse assembly as claimed in any one of claims 2 to 4, wherein each terminal of a pair of the terminals is formed in a blade-shape, and the locking recesses are disposed symmetrically with respect to an axial line which is situated at the center of a pair of the terminals and extends along the direction of the length of the terminal.

6. The fuse assembly as claimed in any one of claims 1 to 4, wherein each teminal of a pair of the terminals has a first through hole, the fuse element has a pair of second through holes, and said each casing member has:

a first projection fitting into the first through hole of one terminal out of a pair of the terminals;

a second projection fitting into one second through hole out of a pair of the second through holes;

a first hole aligning with the first through hole of an opposite terminal out of a pair of the terminals; and a second hole aligning with an opposite second through hole out of a pair of the second through holes.

7. The fuse assembly according to claim 6, wherein a pair of the first through holes is disposed symmetrically with respect to an axial line which is situated at the center of a pair of the terminals and extends along the direction of the length of the terminal, and a pair of the second through holes is also disposed symmetrically with respect to the axial line.

* * * * *